US005365322A

United States Patent [19]

Hamada et al.

[11] Patent Number: 5,365,322

[45] Date of Patent: Nov. 15, 1994

[54] IMAGE FORMING APPARATUS WHICH DETECTS A JAM OF A WOUND SHEET

[75] Inventors: Tatsuo Hamada, Kawasaki; Nobukazu Adachi, Yokohama, both of Japan

[73] Assignee: Canon Kabushiki Kaisha, Tokyo, Japan

[21] Appl. No.: 152,378

[22] Filed: Nov. 16, 1993

[30] Foreign Application Priority Data

Dec. 2, 1992 [JP] Japan ..... 4-361961

[51] Int. Cl.[5] ..... G03G 15/00

[52] U.S. Cl. ..... 355/316; 271/259; 355/203; 355/205; 355/208; 355/308

[58] Field of Search ..... 355/203, 204, 208, 308, 355/309, 316, 205, 207, 317, 321; 271/258, 259

[56] References Cited

U.S. PATENT DOCUMENTS

| | | | |
|---|---|---|---|
| 4,332,457 | 6/1982 | Mitsuyama et al. | 355/309 X |
| 4,516,142 | 5/1985 | Yamamoto et al. | 355/309 |
| 4,684,235 | 8/1987 | Kohmoto et al. | 355/316 |
| 4,937,622 | 6/1990 | Makiura | 355/206 |
| 4,987,448 | 1/1991 | Chikama | 355/205 |
| 5,030,991 | 7/1991 | Zaitsu et al. | 355/207 |
| 5,034,771 | 7/1991 | Makita | 355/204 |

FOREIGN PATENT DOCUMENTS

| | | |
|---|---|---|
| 0113052 | 7/1983 | Japan . |
| 444075 | 2/1992 | Japan . |
| 444076 | 2/1992 | Japan . |
| 444077 | 2/1992 | Japan . |
| 444079 | 2/1992 | Japan . |
| 444080 | 2/1992 | Japan . |
| 444081 | 2/1992 | Japan . |
| 444082 | 2/1992 | Japan . |
| 444083 | 2/1992 | Japan . |

*Primary Examiner*—Matthew S. Smith

*Attorney, Agent, or Firm*—Fitzpatrick, Cella, Harper & Scinto

[57] ABSTRACT

An image forming apparatus includes an image bearing member, a transfer unit for transferring an unfixed image on the image bearing member onto recording material, and a fixing rotating member for fixing the unfixed image while grasping and conveying the recording material supporting the unfixed image. The apparatus further includes a first detector, provided at a side downstream from a grasping portion of the fixing rotating member in the moving direction of the recording material, for detecting the recording material, and a second detector, provided at a side upstream from the grasping portion of the fixing rotating member in the moving direction of the recording material, for detecting the recording material. The distance between the first and second detectors is less than the minimum length in the conveying direction of ordinary recording material used in the apparatus.

7 Claims, 9 Drawing Sheets

IMAGE FORMING APPARATUS WHICH DETECTS A JAM OF A WOUND SHEET

BACKGROUND OF THE INVENTION

1. Field of the Invention

This invention relates to an image forming apparatus which has the function of detecting a jam of a recording material.

2. Description of the Related Art

FIG. 7 illustrates a sheet conveying path from a sheet-feeding unit to a sheet-discharging unit in a conventional image forming apparatus. In FIG. 7, there are shown sheet-feeding cassette 1 of a sheet-feeding unit, and transfer paper P, serving as paper accommodated within the sheet-feeding cassette 1. Sheet-feeding roller 2 is rotatably driven in response to a print start signal, whereby sheets of transfer paper P are individually taken out from within sheet-feeding cassette 1, and each sheet is fed to a transfer process portion of image forming unit 10 passing along a sheet path 6.

In this case, image forming unit 10 has an electrophotographic process mechanism. A drum-shaped electrophotographic photosensitive member (hereinafter termed a "photosensitive drum") 7 is rotatably driven in the clockwise direction indicated by the arrow at a predetermined circumferential speed (process speed).

Primary charging by charging unit (charging roller) 11, image exposure L by exposure means (not shown), such as a laser scanner or the like, and development by developing unit 12 are performed for rotating photosensitive drum 7, and a toner image corresponding to object image information is formed on the circumference of rotating photosensitive drum 7.

The toner image is sequentially transferred onto a sheet of transfer paper P fed from sheet-feeding cassette 1 at transfer nip portion 9 provided between photosensitive drum 7 and transfer unit (tranfer roller) 8.

The sheet of tranfer paper P passing through transfer nip portion 9 is then separated from the surface of rotating photosensitive drum 7, and is guided to fixing unit 17 passing along a sheet path 16. The surface of rotating photosensitive drum 7, after separation of the sheet, is cleaned by cleaning unit 13 to be repeatedly used for image formation.

The fixing unit 17 of the present case comprises a tensionless film-heating-type fixing unit disclosed, for example, in Japanese Patent Laid-open Application (Kokai) Nos. 4-44075-44083 (1992). FIG. 8 is an enlarged view of fixing unit 17.

The fixing unit 17 includes a heat-resistant film guide member 18 having a substantially semicircular cross section, a plate-like ceramic heater 19 having a low heat capacity disposed along the longitudinal direction at a central portion of the lower surface of film guide member 18, a cylindrical (endless) thin film (fixing film) 20 made of heat-resistant resin loosely fit around film guide member 18 having the ceramic heater, and a pressing roller 21 disposed below film guide member 18 so as to be in pressure contact with ceramic heater 19 across film 20 by always being pressed upwardly by upwardly-pressing spring 22. That is, ceramic heater 19 and pressing roller 21 are in pressure contact across film 20, to form a fixing nip portion N.

Ceramic heater 19 is heated by a current supplied from a current supply system (not shown), and is controlled at a predetermined fixing temperature by a temperature control system (not shown).

Pressing roller 21 is rotatably driven by a driving unit (not shown) in the counterclockwise direction indicated by the arrow at a predetermined circumferential speed. The cylindrical film 20 is rotatably driven around film guide member 18 by the rolling frictional force of pressing roller 21 in the clockwise direction indicated by the arrow at a predetermined circumferential speed while sliding along the surface of ceramic heater 19 in a state of firmly contacting the lower surface thereof at the fixing nip portion N.

The sheet of tranfer paper P conveyed to fixing unit 17 after image transfer is guided at entrance guide 23 to enter a space between the rotatably driven cylindrical film 20 and pressing roller 21 at the fixing nip portion N provided by the temperature-controlled ceramic heater 19 and the rotating pressing roller 21, and passes through the fixing nip portion N together with film 20 in a state of firmly contacting the lower surface of ceramic heater 19 across film 20.

While the sheet of transfer paper P passes through the fixing nip portion N, the unfixed toner image on the sheet is heated across film 20 by the heat of ceramic heater 19. Thus, the image is fixed.

The sheet of transfer paper P passing through the fixing nip portion N is separated from the surface of film 20, and is output outside the apparatus after passing through exit guide 24, a sheet path 29 and a pair of sheet-discharging rollers 30.

Referring again to FIG. 7, registration sensor S1 for detecting the leading edge of the sheet is disposed at a side upstream from transfer unit 8 in the conveying direction of the sheet. Discharged-sheet sensor $2 four detecting the discharge of the sheet is disposed at a side downstream from fixing unit 17 in the conveying direction of the sheet.

As shown in FIG. 8, the discharged-sheet sensor S2 of the present case includes a sensor lever 26 swingable around supporting shaft 25, and a photo-interrupter 27. Usually, sensor lever 26 has a substantially vertical posture by the function of gravity as indicated by the solid lines, with the upper-end portion thereof protruding in the sheet path and a lower-end shutter portion 26a thereof blocking the optical path of photo-interrupter 27.

When the sheet is fed from the fixing nip portion N to exit guide 24, sensor lever 26 is pushed by the sheet to be rotated around supporting shaft 25 in the counterclockwise direction as indicated by the two-dot chain lines, whereby shutter portion 26a rotates to open the optical path of photo-interrupter 27.

Thus, the presence/absence of the sheet is detected by the opening/blocking of the optical path of photointerrupter 27. The registration sensor S1 has the same configuration as the discharged-sheet sensor S2.

Signals from registration sensor S1 and discharged-sheet sensor S2 are input to a CPU (not shown) for controlling the main body of the image forming apparatus. Based on these input signals, control of the main body of the apparatus, such as timing control of exposure by a laser when exposure means for the rotating photosensitive drum 7 comprises, for example, a laser scanner, timing control of sheet feeding, control of the fixing sequence, jam detection and the like, is performed.

A heat-roller-type fixing unit comprising a fixing roller, in which a halogen-lamp heater is provided within a roller having the shape of a hollow pipe, and a pressing roller in pressure contact with the fixing roller, a pressure fixing unit comprising a pair of pressing rollers, or the like may be used as the fixing unit 17. However, the film-heating-type fixing unit used in the present case is advantageous over other fixing units in that, for example, waiting time can be shortened (quick-start property) or electrical power consumption can be reduced, since a low-heat-capacity heating member, in which temperature rises rapidly, and a thin film can be used.

In the above-described image forming apparatus, if a paper jam occurs, the CPU for controlling the main body of the apparatus detects the jam from the relationship between the sheet-feeding timing and the signals from the sensors S1 and S2, stops the driving of the main body of the apparatus, and displays the occurrence of the jam.

The operator then opens an openable/closable cover of the main body of the apparatus, removes the jammed paper within the apparatus, and closes again the cover, whereby a door switch linked with the cover is closed. The CPU resets the jammed state by a signal from the door switch. By this reset, the main body of the apparatus executes pre-rotation driving as a mode of forcedly discharging paper, and returns to a state in which image formation can be executed.

In the above-described image forming apparatus, when the openable/closable cover of the main body of the apparatus is first opened after the driving of the apparatus has stopped based on the detection of a jam, and the cover is closed again carelessly or due to some other reason without removing the jammed paper, or when the jammed paper is insufficiently removed, and the cover is closed again without recognizing the presence of a remaining part of the jammed paper, the jammed state is reset based on a signal from the closed door switch, and the pre-rotation driving of the apparatus is executed, whereby the jammed state of the paper still remaining in the apparatus becomes worse, causing, for example, damage to the apparatus. Such problems also arise in the case of reset of the apparatus by the turning-on and turning-off of the power supply of the apparatus.

This is because when, for example, the paper produces an accordion jam, or a jam P' is produced by the paper becoming wound around the fixing member (comprising rotating film 20, pressing roller 21, the heat roller, the pressing roller and the like) of fixing unit 17, as indicated by the two-dot chain lines in FIG. 8, the jammed paper P' is then present between registration sensor S1 for detecting the leading edge of the paper and discharged-sheet sensor S2 for detecting the completion of sheet discharge. The CPU, therefore, cannot detect the presence of the jammed paper P' within the main body of the apparatus when the door switch is closed by closing the cover again, or when the power supply is turned on or off. Thus, the CPU resets the jammed state, and the apparatus moves to the pre-rotation driving in spite of the presence of the jammed paper P'.

Due to the pre-rotation driving, an accordion-jammed paper remaining in the main body of the apparatus may be more severely jammed, or a jammed wound paper P' may be further wound in the fixing member, making jam removing processing by a user difficult or impossible. When the fixing unit 17 is a film-heating-type unit as in the present case, the thin fixing film 20 may be broken.

SUMMARY OF THE INVENTION

It is an object of the present invention to provide an image forming apparatus which can detect a jam of paper wound around a fixing rotating member.

It is another object of the present invention to provide an image forming apparatus in which reset of a jammed state is not performed unless jammed paper is removed.

According to one aspect, the present invention which achieves these objectives relates to an image forming apparatus comprising image forming means for forming an unfixed image on a recording material fed from a sheet-feeding portion, a fixing rotating member, having a grasping portion, for fixing the unfixed image while grasping and conveying the recording material which supports the unfixed image and a first detection member, provided at a side downstream from the grasping portion of the fixing rotating member in the moving direction of the recording material, for detecting the recording material. The apparatus also has a second detection member, provided at a side upstream from the grasping portion of the fixing rotating member in the moving direction of the recording material, for detecting the recording material, wherein the distance between the first and second detection members is shorter than the minimum length in the conveying direction of ordinary paper used in the apparatus.

Another aspect of the present invention provides an image forming apparatus that includes the features of image forming means for forming an unfixed image on a recording material and a fixing device for fixing the unfixed image on the recording material. A jam-detection sensor outputs a first sensor signal indicating whether the recording material is present at the jam-detection sensor, a recording-material-presence sensor outputs a second sensor signal indicating whether the recording material is present at the recording-material-presence sensor and reset signal generation means outputs a reset signal under predetermined conditions. Control means receives the first and second sensor signals and the reset signal. The control means detects occurrence of a jam based on the first sensor signal, and the control means resets the apparatus when it receives the reset signal and the second sensor signal indicates the absence of the recording material from the recording-material-presence sensor.

Yet another aspect of the present invention provides a method for resetting an image forming apparatus. A sensor signal is generated by a jam-detection sensor and is received by a control unit. The control unit detects occurrence of a jam based on the signal from the jam-detection sensor. A reset signal is generated when action associated with jam removing processing by a user occurs, and the reset signal is received by the control unit. A recording-material-presence signal is generated by a recording-material-presence sensor, indicating whether the recording material is present at the recording-material-presence sensor, and the control unit receives the recording-material-presence signal. The control unit resets the apparatus when the reset signal is received and the received recording-material-presence signal indicates that the recording material is absent from the recording-material-presence sensor.

These and other objects, advantages and features of the present invention will become more apparent from the following description of the preferred embodiments taken in conjuction with the accompanying drawings.

BRIEF DESCRIPTION OF THE DRAWINGS

FIG. 3(*b*) is a diagram illustrating the posture of a sensor lever when the absence of a sheet is detected;

FIG. 3(*c*) is a diagram illustrating the posture of the sensor lever when the presence of a sheet is detected;

FIG. 6(*a*) is a diagram illustrating the posture of a sensor lever in a usual sheet-feeding state; FIG. 6(*b*) is a diagram illustrating the posture of the sensor lever when a jammed sheet is detected; and FIG. 6(*c*) is a diagram illustrating the posture of the sensor lever when the absence of a sheet is detected;

DESCRIPTION OF THE PREFERRED EMBODIMENTS

Figure 1:
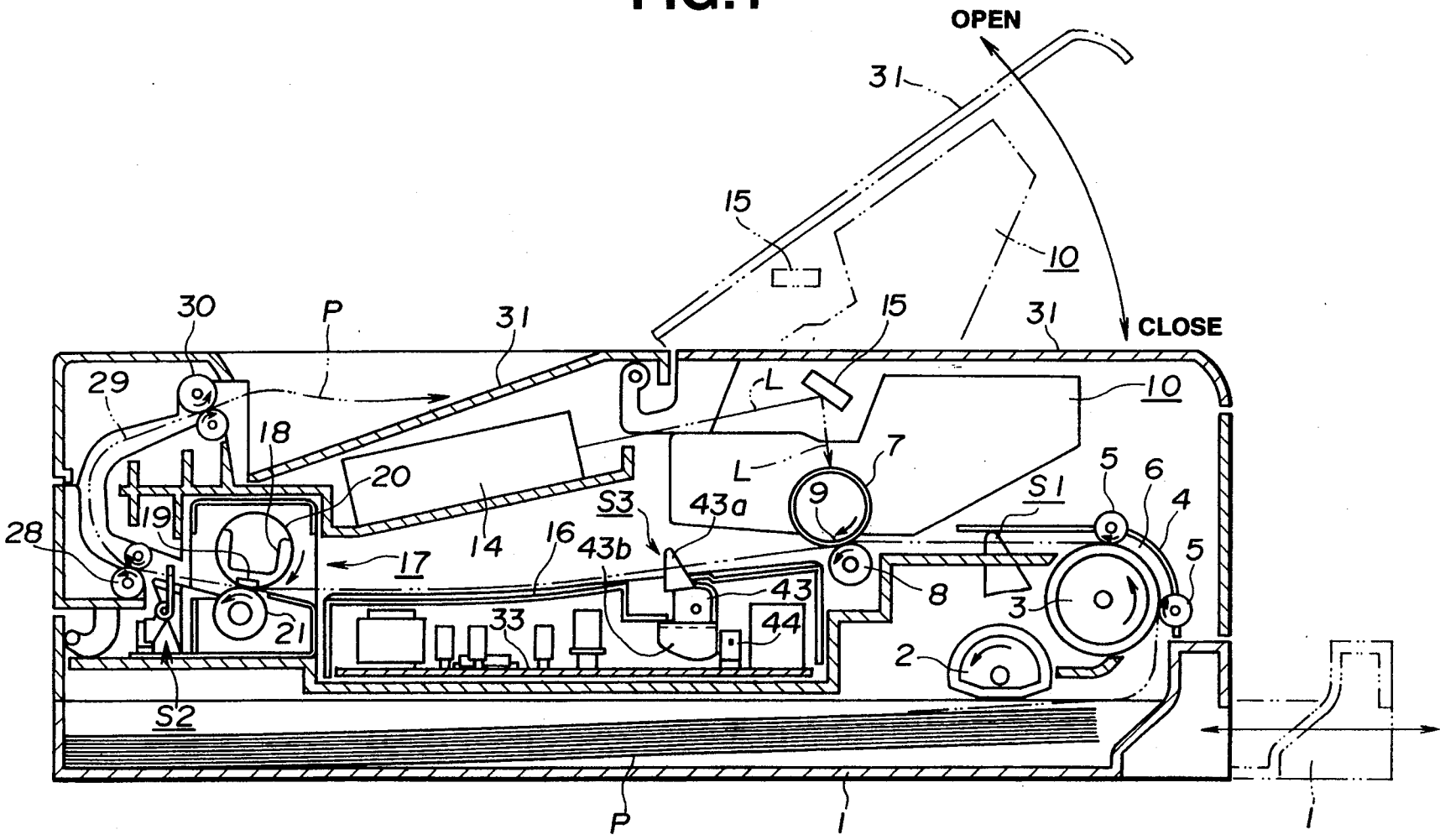
FIG. 1 is a cross-sectional view of an image forming apparatus according to an embodiment of the present invention.

FIG. 1 is a cross-sectional view of an image forming apparatus according to an embodiment of the present invention.

In FIG. 1, there are shown sheet-feeding cassette 1, and sheets of transfer paper P accommodated within the cassette 1. The sheet-feeding cassette 1 can be mounted in and detached from a mounting unit present at a lower portion of the main body of the apparatus by inserting and withdrawing the cassette as indicated by the two-headed arrow from the front side of the apparatus.

A driving force is transmitted to a single-rotation control clutch (not shown) in response to a print start signal to drive sheet-feeding roller 2 by a single revolution, whereby one sheet of transfer paper P within sheet-feeding cassette 1 is fed in the forward direction of the cassette. The fed sheet is conveyed in a direction reversed by 180° passing along a reversal sheet path 6 provided by reversal roller 3, guide 4, roller 5 and the like so as to be fed backwardly within the apparatus, and is guided to a pressure-contact nip portion (transfer portion) 9 between photosensitive drum 7 and transfer unit 8, where a toner image formed and carried on the surface of drum 7 is transferred onto the fed sheet.

Process cartridge 10 is detachably mounted to the main body of the apparatus. Although omitted in FIG. 1, the process cartridge 10 includes the charging unit 11, developing unit 12, cleaning unit 13 and the like shown in FIG. 7.

Laser scanner unit 14 outputs laser light L modulated corresponding to a time-serial electrical digital pixel signal of object image information to perform main-scanning exposure (laser write exposure) of the surface of rotating photosensitive drum 7 via reflecting mirror 15.

The sheet passing through the transfer portion 9 is conveyed to fixing unit 17 by being guided by conveying guide 16, and the transferred image on the sheet is fixed in fixing unit 17. Since the fixing unit 17 of the present embodiment is the same as the tensionless film-heating-type fixing unit 17 shown in FIGS. 7 and 8, further explanation thereof will be omitted.

The sheet passing through fixing unit 17 further passes through a pair of relay conveying rollers 28, a sheet path 29 and a pair of sheet-discharging rollers 30, and is output onto sheet discharge tray 31 provided at the upper surface of the apparatus.

Openable/closable cover 31 provided at the upper surface of the apparatus can be opened around hinge shaft as indicated by the two-dot chain lines. By thus opening the cover 31, the process cartridge 10 is also raised to largely expose the inside of the apparatus, whereby a jammed sheet within the apparatus can be removed, the inside of the apparatus can be checked, and the process cartridge can be detached.

An integrated substrate 33, on which electrical components, such as a power supply, a CPU (central processing unit), a driving circuit of the main body of the apparatus, a high-voltage unit and the like, are mounted, is disposed in a space provided between sheet-feeding cassette 1 and conveying guide 16. The conveying guide 16 is made of a sheet metal, and the substrate 33 is shielded by being covered by the conveying guide 16.

Electrical units, such as fixing unit 17, transfer unit 8, scanner unit 14 and the like, are automatically connected electrically to the integrated substrate 33 using floating connectors (not shown) when mounting them in the main body of the apparatus, in order to provide a compact and low-cost apparatus. By adopting a film-heating-type fixing unit, which has the feature of capable of instantaneously performing fixing processing without providing a warm-up time, as the fixing unit 17, the capacity of the power supply can be reduced, so that the above-described integrated substrate 33 can be realized, whereby a compact and low-cost apparatus can be provided.

Figure 7:
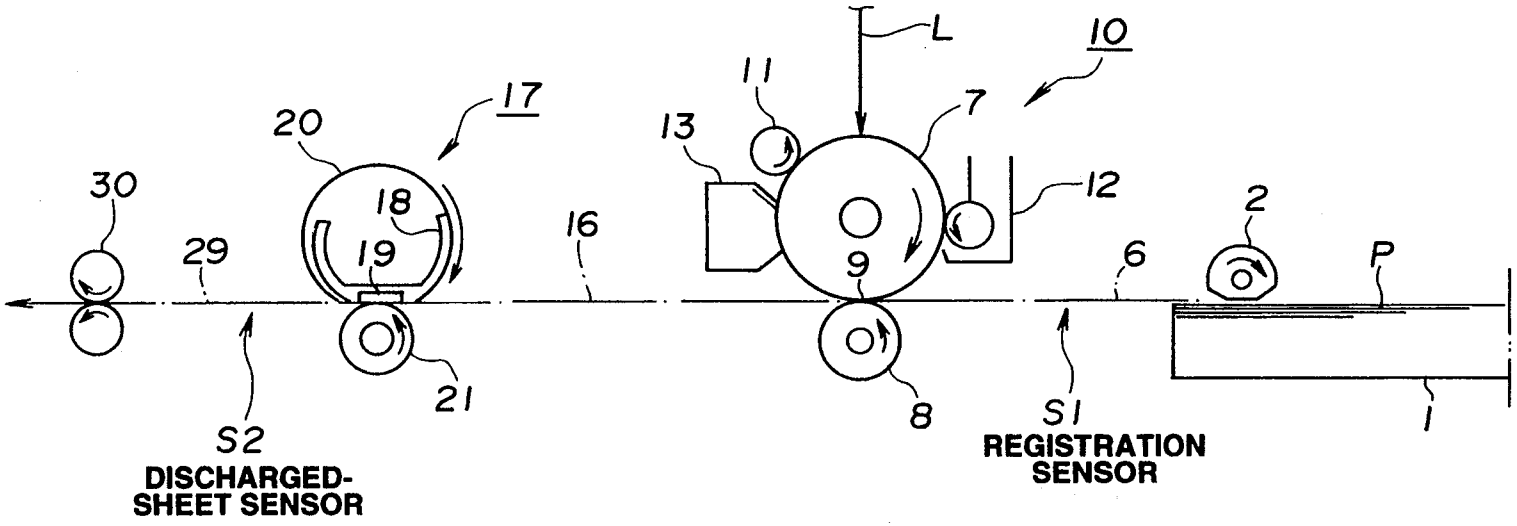
FIG.7 (PRIOR ART)
FIG. 7 is a development of a sheet-feeding path from a sheet-feeding unit to a sheet-discharging unit in an image forming apparatus.

In FIG. 1, the registration sensor S1 described with respect to FIG. 7 is used. The registration sensor S1 detects the leading edge of the sheet fed from the sheet-feeding unit to the transfer portion 9 to provide the write timing of the laser in laser scanner 14, and also detects the presence of a remaining sheet when the main body of the apparatus is started.

Figure 8:
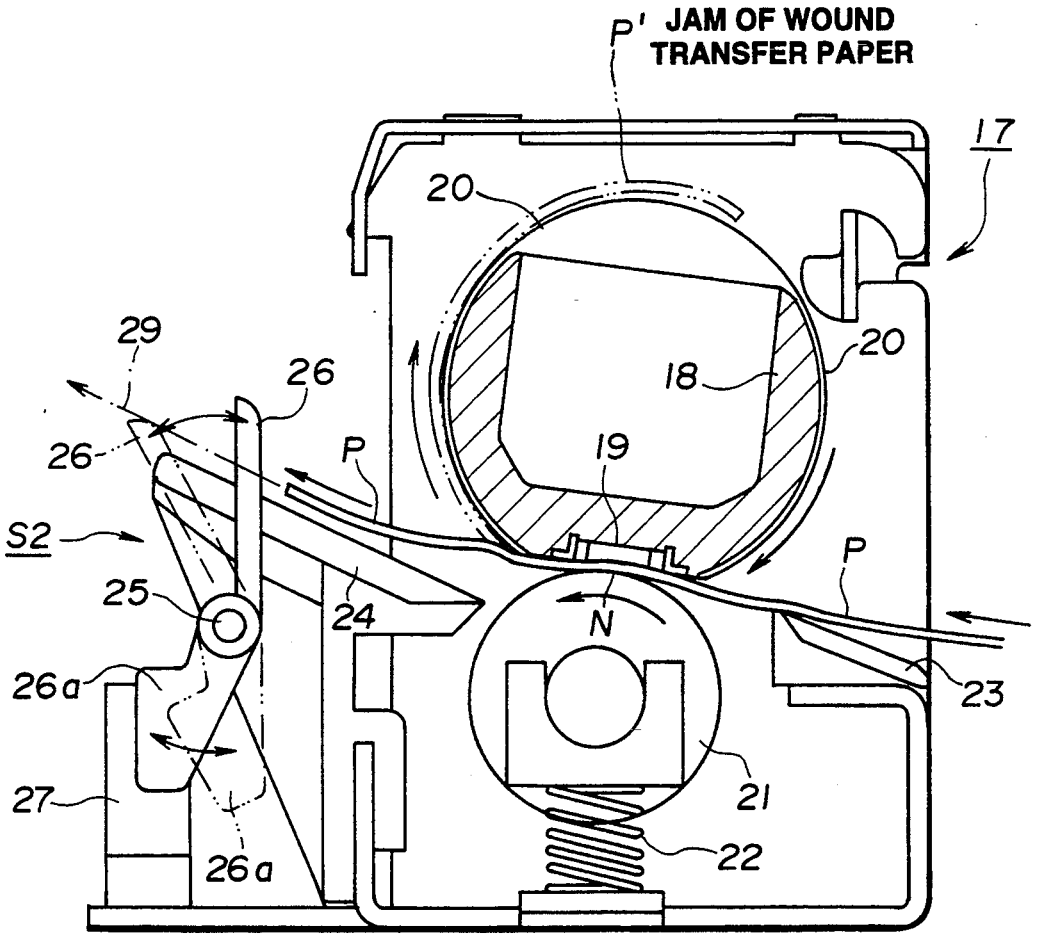
FIG.8 (PRIOR ART)
FIG. 8 is an enlarged view of a film-heating-type fixing unit.

The discharged-sheet sensor (the detection member provided behind the fixing portion) S2 described with respect to FIGS. 7 and 8 is also used. The discharged-sheet sensor S2 detects the arrival of the leading edge of the sheet which has left fixing unit 17 and the escape (passage) of the trailing edge of the sheet, as well as the presence of a remaining sheet when starting the apparatus.

Symbol S3 represents a sensor for detecting the presence/absence of a remaining sheet (a detection member provided in front of the fixing portion), which is disposed along the sheet path from the transfer portion 9 to fixing unit 17.

When sensor S2 does not detect the sheet within a predetermined time (which is somewhat longer than the time required for the leading edge of the sheet to reach sensor S2 without producing a jam) from the time when sensor S1 has detected the sheet, the CPU determines that a jam has occurred, stops the driving of the main body of the apparatus, and displays the occurrence of the jam.

Figure 2:
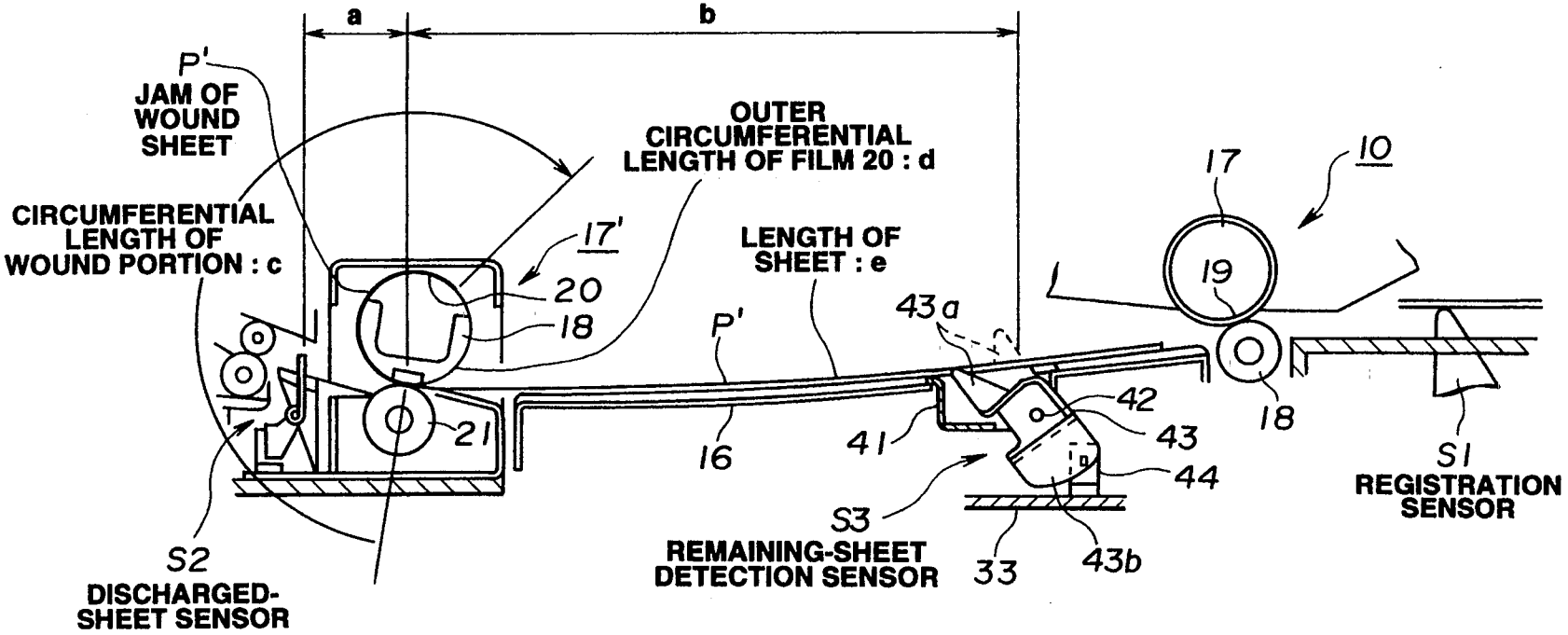
FIG. 2 is a diagram illustrating a state in which a jam of a wound sheet occurs.

FIG. 2 illustrates a state in which a jam P' of a sheet of transfer paper P becoming wound around rotating fixing film 20 of fixing unit 17 occurs. In such a case, the CPU counts the time from the sheet-feeding timing, and determines that a jam of a wound sheet has occurred, since discharged-sheet sensor S2 does not detect the arrival of the leading edge of the sheet although the time required for the leading edge of the sheet to reach discharged-sheet sensor S2, serving as the detection member provided behind the fixing portion, has elapsed. Therefore, the CPU immediately stops the driving of the apparatus.

The operator opens openable/closable cover 31 of the apparatus to expose the inside of the apparatus, removes the jammed sheet P', and closes again the cover 31. By thus closing the cover 31, the door switch is closed, and the CPU resets the jammed state in response to a signal from the door switch. By this reset, the pre-rotation driving of the main body of the apparatus is executed to return to a state capable of executing image formation.

In the apparatus of the present embodiment, in order to securely detect a jam P' of a sheet of transfer paper P wound around rotating fixing film 20, and to prevent the sheet from being wound around rotating fixing film 20 more than one circumference of film 20 in order to facilitate jam recovering processing, sensor S2 is provided at such a position that the relationship "$d>c>a$" holds, where "a" is the distance from the fixing nip portion N to sensor S2, d is the outer circumference of rotating fixing film 20, and c is the circumferential length from the leading edge of the wound sheet to the fixing nip portion N.

By stopping the driving of the apparatus based on the result of the detection of sensor S2, the amount of the wound sheet can be shorter than the circumference of fixing film 20 even if a jam due to the sheet becoming wound around fixing film 20 occurs.

In order to securely detect the presence/absence of jammed sheet P' in such a state, sensor S3 for detecting the presence/absence of a remaining sheet, serving as the detection member in front of the fixing portion, is provided at such a position on conveying guide 18 that even minimum-size (A5-size) ordinary paper which can be used in the apparatus of the present embodiment can be detected.

More specifically, sensor S3 is provided at such a position that the relationship "$e-c>b$" holds, where, in a condition of conveying A-4 size paper in its longitudinal direction, e is the length of the A-4 size paper in the longitudinal direction, and b is the distance from the fixing nip portion N to the sensor S3.

That is, discharged-sheet sensor S2, serving as the detection member provided behind the fixing portion, is provided at such a position that the distance "a" from fixing portion N when detecting the leading edge of the sheet is shorter than the circumference d of rotating fixing film 20, and sensor S3 for detecting the presence/absence of a remaining sheet, serving as the detection member provided in front of the fixing portion, is provided at such a position that the distance $(a+b)$ from the sheet-discharging sensor S2 is shorter than the length e of the sheet.

Sensor S3 for detecting the presence/absence of a remaining sheet detects the presence of a sheet while the sheet is passing in a usual sheet-feeding state (while the sheet is normally conveyed). However, the CPU neglects a signal representing the detection of the presence of the sheet from sensor S3 in this usual sheet-feeding state.

On the other hand, after the jam P' of the wound sheet shown in FIG. 2 has occurred and the CPU has detected the occurrence of the jam, the driving of the apparatus is stopped in a state in which the jammed sheet P' causes the sensor S3 to operate, and a signal representing the presence of the sheet is input from the sensor S2 to the CPU.

Unless the jammed sheet P' is removed and the output of sensor S3 indicates the absence of the sheet, the CPU does not reset the jammed state even if a reset caused by the door switch being closed by closing again openable/closable cover 31 without removing the jammed sheet P', or a reset caused by turning on or off the power supply, is performed, since sensor S3 for detecting the presence/absence of a remaining sheet detects the presence of the sheet although registration sensor S1 and discharged-sheet sensor S2 detect the absence of the sheet. That is, the driving of the main body of the apparatus is not performed unless the jammed sheet P' is removed.

When the outputs of both discharged-sheet sensor S2 and sensor S3 for detecting the presence/absence of a remaining sheet indicate the detection of the presence of a sheet, that does not indicate a jam of a wound sheet. Hence, the main body of the apparatus is driven after a reset, and the sheet is forcedly discharged.

Figure 9:
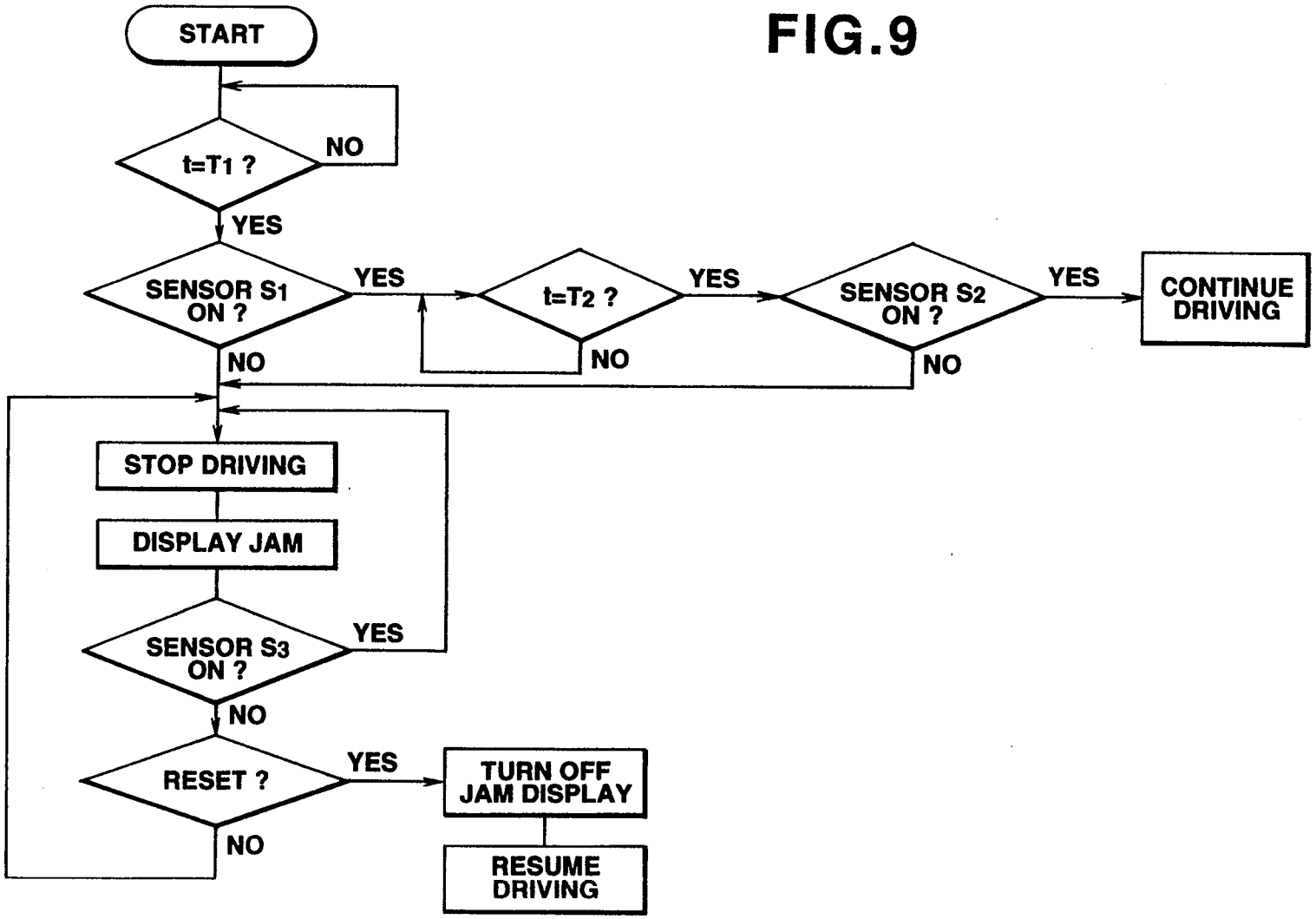
FIG. 9 is a flowchart illustrating the sequence of jam detection in the first embodiment of the present invention.

FIG. 9 is a flowchart illustrating the jam detection sequence of the present embodiment.

Figure 3A:
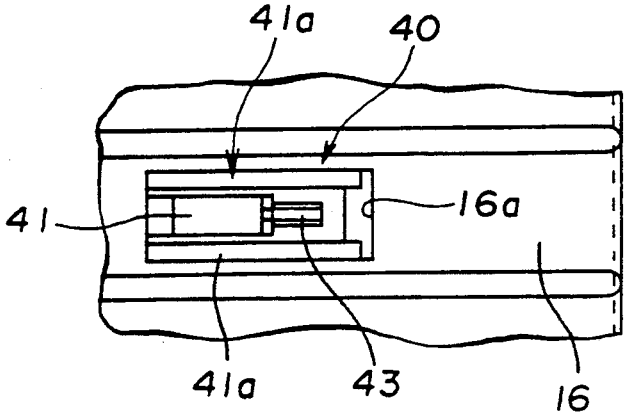
FIG. 3(*a*) is a plan view illustrating the neighborhood of a sensor for detecting a remaining sheet.
Figure 3B:
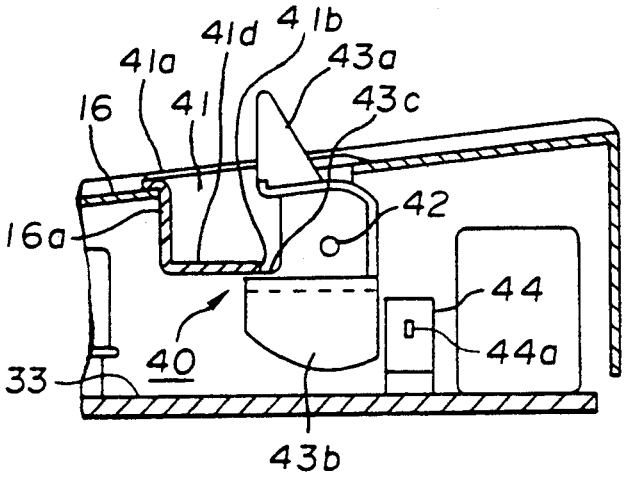
Figure 3C:
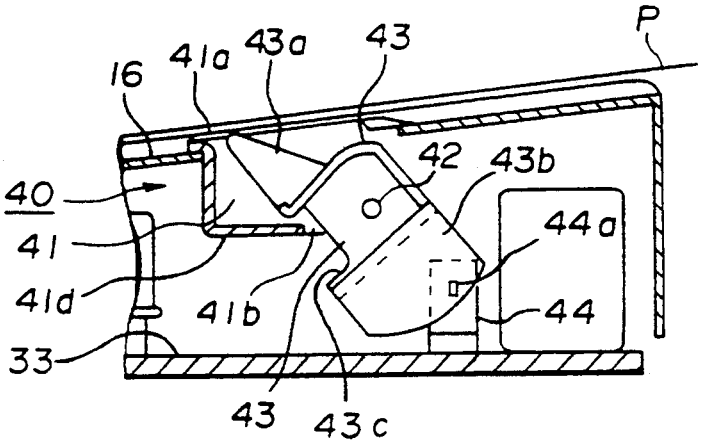

FIG. 3(*a*) is a plan view illustrating the neighborhood of sensor S3 for detecting the presence/absence of a remaining sheet. FIGS. 3(*b*) and 3(*c*) are side views illustrating the postures of the sensor lever when no sheet is present and when a sheet is present, respectively.

In FIGS. 3(*a*) through 3(*c*), sensor-lever unit 40 includes a sensor-lever holding member 41 having the shape of a box whose upper surface is opened, and a sensor lever 43 swingably supported around supporting shaft 42 within the member 41.

The sensor-lever unit 40 is mounted and held in conveying guide 16 by being fitted in a unit-fitting hole 16*a* provided on the surface of conveying guide 16 and pushed until a detachment-preventing collar (pawl portion) 41*a* provided at an upper portion of the box-like sensor-lever holding member 41 contacts the surface of conveying guide 16.

Reference numeral 43*a* represents the upper portion of sensor lever 43, and reference numeral 43*b* represents a shutter unit provided at a lower portion of sensor lever 43. Shutter unit 43*b* protrudes downwardly from a hole portion 41*b* formed at the base and a side of the box-like sensor-lever holding member 41. In a free state, a moment to rotate sensor lever 43 around supporting shaft 42 in a clockwise direction is applied to sensor lever 43 by its own weight. As shown in FIG. 3(*b*), jaw portion 43*c* of shutter unit 43*b* contacts the lower surface of the base 41*d* of the sensor-lever holding member, whereby further rotation of sensor lever 43 is hindered, and sensor lever 43 is held at a substantially vertical posture.

In this state, the upper-end portion 43*a* of sensor lever 43 protrudes from the upper-surface opening of the box-like sensor-lever holding member 41, i.e., the upper surface of conveying guide 16. Shutter unit 43*b* provided at the lower-end side of sensor lever 43 is in a position retracted from the optical path 44*a* of photo-interrupter 44 provided on substrate 33, whereby the optical path 44*a* is opened.

While the sheet of transfer paper P is passing on conveying guide 16, sensor lever 43 is rotated around supporting shaft 42 in a counterclockwise direction against the above-described rotational moment in the clockwise direction caused by the sheet of transfer paper P contacting the upper-end portion 43*a* of sensor lever 43, as shown in FIG. 3(*c*). Thus, the upper-end portion 43*a* is tilted within the box-like sensor-lever holding member 41, and shutter unit 43*b* provided at the lower-end side of sensor lever 43 enters the optical path 44*a* of photo-interrupter 44, whereby the optical path 44*a* is blocked, and a state of detecting the presence of a sheet is provided.

According to this configuration of sensor S3, even if toner, the powder of the sheet, a clip or the like drops within the box-like sensor-lever holding member 41 in the state of detecting the absence of a sheet shown in FIG. 3(*b*), it does not drop onto substrate 33, since the base 41*d* is present.

Furthermore, in the state of detecting the presence of a sheet shown in FIG. 3(*c*), since the upper-end portion 43*a* of sensor lever 43 is tilted within the box-like sensor-lever holding member 41, no problem arises in feeding the sheet.

As described above, by providing sensor S3 for detecting a remaining sheet, serving as a third sensor, at a position that even a small-size jammed sheet, such as an A4-size sheet, which cannot be detected by sensors S2 and S1, can be detected, in an image forming apparatus including discharged-sheet sensor S2 having a sequence of detecting a sheet of transfer paper P wound around a fixing unit and leading-edge registration sensor S1, the jammed state is not reset unless the jammed sheet wound around the fixing member is removed. Thus, the phenomena that the jammed sheet remaining within the apparatus is more severely jammed, and that the jammed sheet is further wound around the fixing unit, making jam recovering processing by a user difficult or impossible, or the destruction of the apparatus, will not occur, causing an improvement in the reliability of the apparatus.

Figure 4:
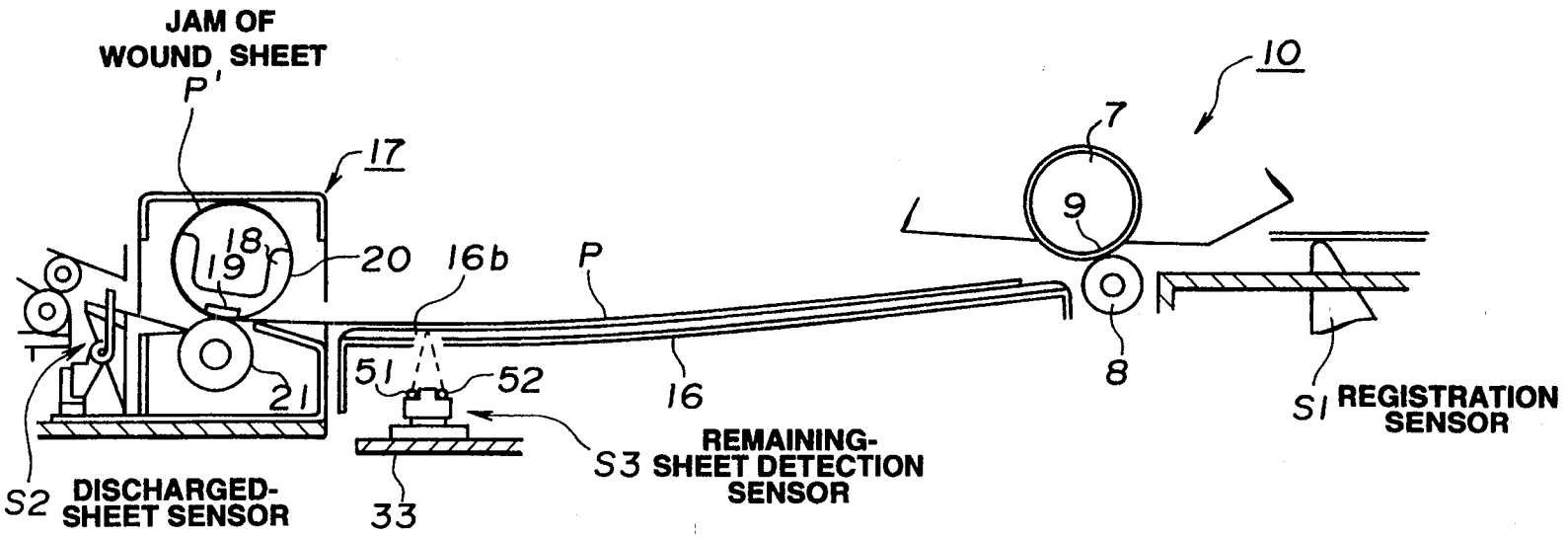
FIG. 4 is a diagram illustrating a principal portion of an apparatus according to another embodiment of the present invention.

FIG. 4 illustrates another embodiment of sensor S3.

In this embodiment, the sensor S3 for detecting the presence/absence of a remaining sheet comprises a photocoupler in which an infrared light-emitting device 51 and an infrared photosensor 52 are integrated.

This photocoupler is provided on the substrate 33. Infrared radiation emitted from light-emitting device 51 reaches the sheet-conveying surface of conveying guide 16 through a hole 16*b* provided in conveying guide 16.

When the sheet of transfer paper P is absent, the infrared radiation is not reflected and returns to photosensor 52, whereby the absence of the sheet is detected. When the sheet of transfer paper P is present, the infrared radiation is reflected by the back of the sheet, and reaches photosensor 52, whereby the presence of the sheet is detected.

The configuration and the control of other components in the present embodiment is the same as in the first embodiment.

Figure 5:
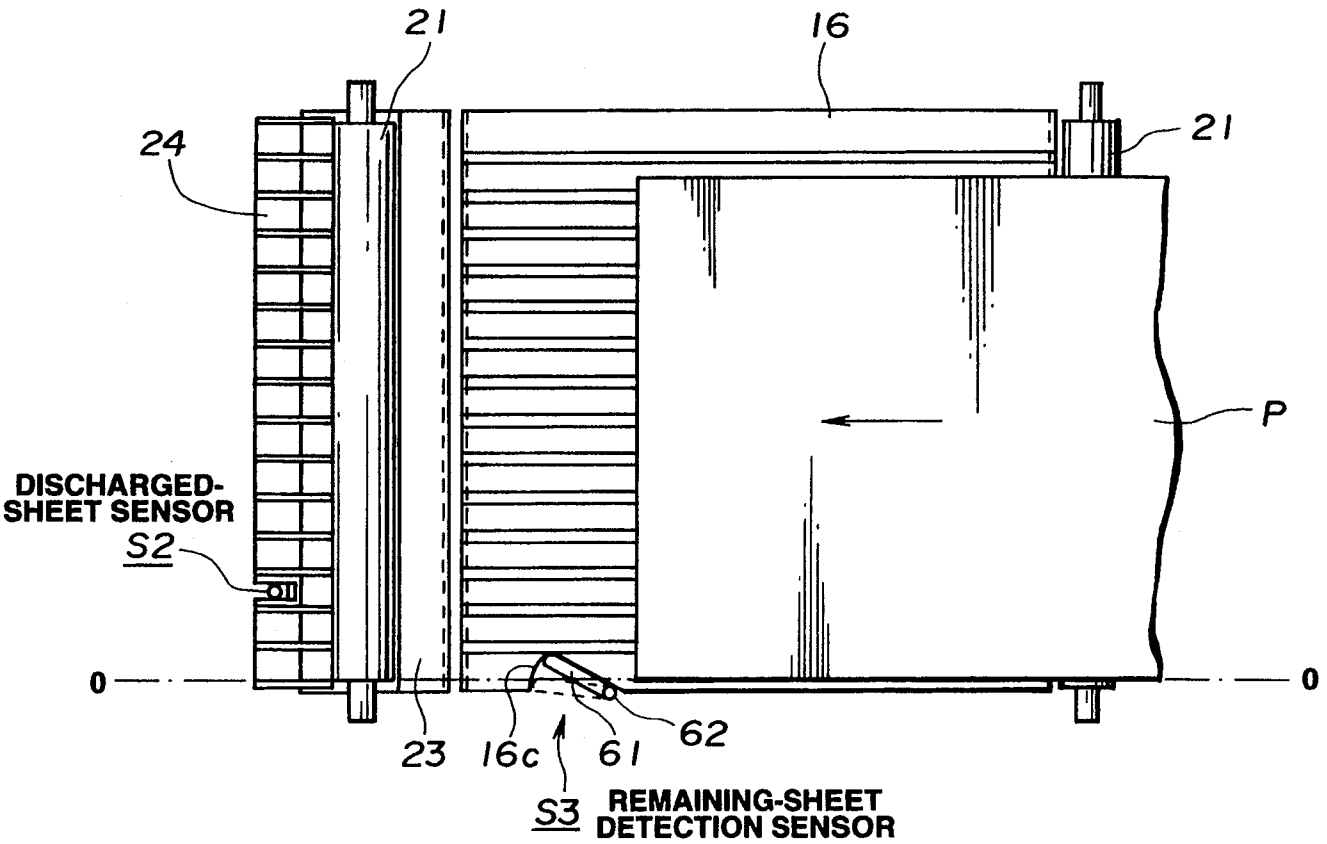
FIG. 5 is a plan view of a principal portion of an apparatus according to still another embodiment of the present invention.

FIG. 5 illustrates still another embodiment of sensor S3 for detecting the presence/absence of a sheet. In FIG. 5, reference numeral 16c represents a fan-shaped notch formed at a side portion of conveying guide 16 at the side of one-side reference conveying line 0—0 for a sheet.

Lever member 61 with its center of rotation 62 is rotatably accommodated within the fan-shaped notch 16*c* of conveying guide 16, and is rotatably driven in the direction of entering the fan-shaped notch 16*c*.

When the sheet of transfer paper P is conveyed, the side of the sheet at the side of the reference conveying line 0—0 interferes with lever member 61 to rotate it around its center of rotation 62 outwardly as indicated by the two-dot chain lines. The rotation of lever member 61 is detected by on/off of a photo-interrupter (not shown) to detect the absence/presence of the sheet.

In the present embodiment, the presence/absence of the sheet can be detected not at the back of the sheet, but at the side of the sheet. Hence, the present embodiment is effective in the case of conveying a sheet with a reference provided at one side of the sheet.

The configuration and the control of other components in the present embodiment are the same as in the first embodiment.

Figure 6A:
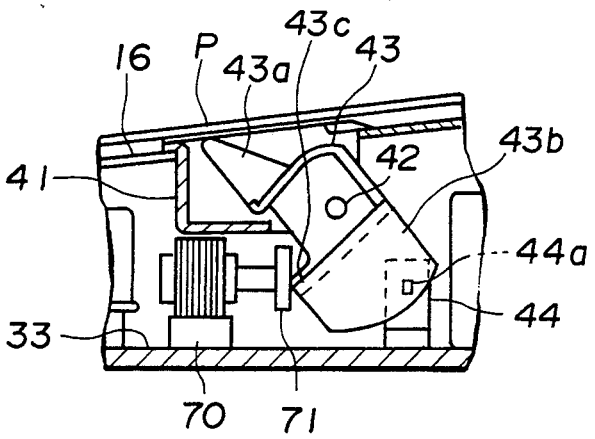
FIGS. 6(*a*) through 6(*c*) are diagrams illustrating a sensor for detecting a remaining sheet in an apparatus according to still another embodiment of the present invention.
Figure 6B:
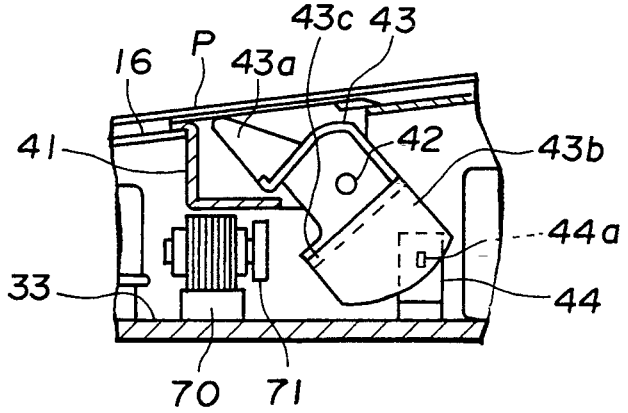
Figure 6C:
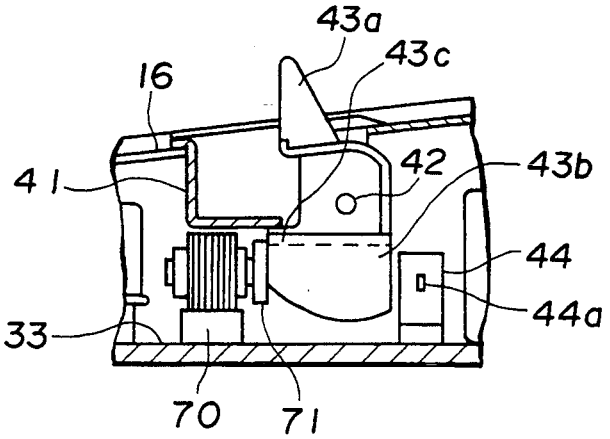

FIGS. 6(*a*) through 6(*c*) illustrate still another embodiment of sensor S3.

The sensor of the present embodiment differs from sensor S3 for detecting the presence/absence of a remaining sheet (shown in FIGS. 3(*a*) through 3(*c*)) of the apparatus of the first embodiment in that, as shown in FIG. 6(*a*), in a usual sheet-feeding state (when a sheet is normally conveyed), a plunger 71 of a solenoid 70 provided on the substrate 33 is held in a protruded state to press shutter unit 4 3*a* of sensor lever 43, and thereby to maintain sensor lever 43 in a state of being rotated around supporting shaft 42 in a counterclockwise direction.

Thus, the upper-end portion 4 3*a* of sensor lever 43 enters the box-like sensor-lever holding member 41 to be maintained in a state of retraction from the sheet conveying path on conveying guide 16. Therefore, in a usual sheet-feeding state, unnecessary contact sliding between the back of the sheet of transfer paper P and the upper-end portion 43*a* of sensor lever 43 is prevented, whereby the provision of a trace of contact with the upper-end portion of the sensor lever on the sheet is prevented.

In this case, the optical path 44*a* of photo-interrupter 44 is blocked by shutter unit 43b, and a signal indicating the presence of the sheet is input to the CPU. However, the CPU neglects the signal indicating the presence of the sheet from sensor S3 in the usual sheet-feeding state.

On the other hand, when a sheet jam is detected by the cooperation of sensors S1 and S2 and the CPU, the apparatus is immediately stopped in response to a jam detection signal, and plunger 71 of solenoid 70 is maintained in a retracted state in response to the signal, as shown in FIG. 6(*b*), to release the pressing of shutter unit 43*b* of sensor lever 43.

By this release, sensor lever 43 intends to rotate around supporting shaft 42 in a clockwise direction by the moment produced by its own weight. However, when a jammed sheet P′ is present on sensor S3, the upper-end portion 43*a* of sensor lever 43 contacts the back of the jammed sheet P′ to prevent further rotation of sensor lever 43 in the clockwise direction. Thus, the optical path 44*a* of photointerrupter 44 is maintained in a state of being blocked by shutter unit 43b, whereby the presence of the sheet is detected.

When a jammed sheet P′ is absent on sensor S3, sensor lever 43 rotates around supporting shaft 42 by the moment produced by its own weight until the lever reaches the state of a substantially vertical posture. Thus, the optical path 44*a* of photo-interrupter 44 is opened by the retraction of shutter unit 43b, whereby the absence of the sheet is detected.

As in the case of the first embodiment, as long as sensor S3 detects the presence of the sheet as shown in FIG. 6(*b*), the CPU does not reset the jammed state even if a reset produced when openable/closable cover 31 is closed again to close the door switch, or a reset caused by the on/off of the power supply, is performed.

If the jammed sheet P′ is removed in the state shown in FIG. 6(*b*), sensor lever 43 rotates around supporting shaft 42 until the lever reaches the state of the substantially vertical posture shown in FIG. 6(*c*). Thus, the optical path 44*a* of photo-interrupter 44 is opened by the retraction of shutter unit 43*b*, whereby the absence of the sheet is detected. Thus, the CPU can reset the jammed state.

Although the fixing unit used in each of the above-described embodiments is a film-heating-type unit, a heat-roller-type unit, a pressure-fixing-type unit or the like may also be used as the fixing unit.

The individual components shown in outline or designated by blocks in the drawings are all well-known in the image formation and device manufacturing arts, and their specific construction and operation are not critical to the operation or best mode for carrying out the invention.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus for forming an image on a recording material fed from a sheet-feeding portion, said apparatus comprising:

image forming means for forming an unfixed image on the recording material fed from the sheet-feeding portion;

a fixing rotating member, having a grasping portion, for fixing the unfixed image while grasping and conveying the recording material which supports the unfixed image;

a first detection member, provided at a side downstream from the grasping portion of said fixing rotating member in the moving direction of the recording material, for detecting the recording material; and a second detection member, provided at a side upstream from the grasping portion of said fixing rotating member in the moving direction of the recording material, for detecting the recording material, wherein the distance between said first detection member and said second detection member is less than a minimum length in the conveying direction of ordinary recording material used in said apparatus.

2. An apparatus according to claim 1, wherein the distance between the grasping portion and said first detection member is less than a circumference of said fixing rotating member.

3. An apparatus according to claim 1, wherein said fixing rotating member is contactable with the unfixed image.

4. An apparatus according to claim 1, wherein the distance between said first and second detection members is less than the length of A5 paper in the conveying direction and the minimum size of ordinary recording material used in said apparatus is A5 paper.

5. An apparatus according to claim 1, further comprising determination means for determining that a jam has occurred when said first detection member does not detect the recording material.

6. An apparatus according to claim 5, further comprising stopping means for stopping driving of said apparatus when said determination means determines that a jam has occurred, and resetting means for resetting a jammed state.

7. An apparatus according to claim 6, further comprising prohibition means for prohibiting the reset of the jammed state while said second detection member detects the recording material after the stoppage of the driving by said stopping means.

* * * * *

UNITED STATES PATENT AND TRADEMARK OFFICE

CERTIFICATE OF CORRECTION

PATENT NO. : 5,365,322
DATED : November 15, 1994
INVENTOR(S) : TATSUO HAMADA, ET AL.

It is certified that error appears in the above-indentified patent and that said Letters Patent is hereby corrected as shown below:

Title page, item [56] References Cited:
line FPD, "444075" should read --4-44075--;
"444076" should read --4-44076--;
"444077" should read --4-44077--;
"444079" should read --4-44079--;
"444080" should read --4-44080--;
"444081" should read --4-44081--;
"444082" should read --4-44082--; and
"444083" should read --4-44083--.

Column 2,
line 34, "$2 four" should read --S2 for--.

Signed and Sealed this

Twenty-eight Day of March, 1995

Bruce Lehman

*Attest:*

BRUCE LEHMAN

*Attesting Officer*

*Commissioner of Patents and Trademarks*